US012590592B2

(12) United States Patent
Chen

(10) Patent No.: US 12,590,592 B2
(45) Date of Patent: Mar. 31, 2026

(54) AIR GUIDE FRAME, FAN HEAD, AND HANDHELD CONCENTRATING FAN

(71) Applicant: SHENZHEN AIKULI TECHNOLOGY CO., LTD, Guangdong (CN)

(72) Inventor: Miaosheng Chen, Guangdong (CN)

(73) Assignee: SHENZHEN AIKULI TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/299,774

(22) Filed: Aug. 14, 2025

(65) Prior Publication Data

US 2026/0036141 A1 Feb. 5, 2026

Related U.S. Application Data

(63) Continuation of application No. PCT/CN2024/139031, filed on Dec. 13, 2024.

(30) Foreign Application Priority Data

Aug. 2, 2024 (CN) ..... 202421860657.0

(51) Int. Cl.

| | |
|---|---|
| ***F04D 29/54*** | (2006.01) |
| ***F04D 19/00*** | (2006.01) |
| ***F04D 29/70*** | (2006.01) |

(52) U.S. Cl.

CPC ..... *F04D 29/54* (2013.01); *F04D 19/002* (2013.01); *F04D 29/703* (2013.01)

(58) Field of Classification Search

CPC ..... F04D 29/54; F04D 29/703; F04D 25/084

See application file for complete search history.

(56) References Cited

U.S. PATENT DOCUMENTS

| | | | | |
|---|---|---|---|---|
| 4,189,281 | A * | 2/1980 | Katagiri | F04D 29/384 165/122 |
| 11,566,628 | B1 * | 1/2023 | Liu | F04D 19/002 |
| 2005/0186070 | A1 * | 8/2005 | Zeng | F04D 29/544 415/211.2 |
| 2005/0191955 | A1 * | 9/2005 | Horng | F04D 29/544 454/184 |

(Continued)

FOREIGN PATENT DOCUMENTS

| | | | | |
|---|---|---|---|---|
| CN | 212155257 U | * | 12/2020 | |
| WO | WO-2021036188 A1 | * | 3/2021 | F04D 29/325 |

*Primary Examiner* — Eldon T Brockman

(74) *Attorney, Agent, or Firm* — HOWARD M COHN and Associates, LLC

(57) ABSTRACT

An air guide frame, a fan head, and a handheld concentrating fan are provided. The air guide frame is configured to be arranged at an air outlet of a fan head and guide air from a fan. the air guide frame includes an inner frame and a separator ring arranged at a periphery of the inner frame; a first air channel is formed in a periphery of the separator ring; a second air channel is formed between the inner frame and the separator ring; and a wind speed of wind exported from the second air channel is greater than a wind speed of wind exported from the first air channel. Compared with the existing technology, the air guide frame having the first air channel and the second air channel can implement the wind speeds of winds blown out through the two air channels being different.

13 Claims, 15 Drawing Sheets

(56) References Cited

U.S. PATENT DOCUMENTS

| | | | | |
|---|---|---|---|---|
| 2009/0081036 | A1* | 3/2009 | Takeshita | F04D 25/0613<br>415/208.2 |
| 2015/0275918 | A1* | 10/2015 | Hausmann | F04D 29/541<br>415/207 |
| 2015/0330411 | A1* | 11/2015 | Heli | F04D 29/325<br>415/208.2 |

* cited by examiner

AIR GUIDE FRAME, FAN HEAD, AND HANDHELD CONCENTRATING FAN

CROSS-REFERENCE TO RELATED APPLICATION

This application is a continuation of International Application No. PCT/CN2024/139031, filed on Dec. 13, 2024, which claims priority to Chinese Patent Application No. 2024218606570, filed on Aug. 2, 2024, the entire contents of which are incorporated herein by reference.

TECHNICAL FIELD

The present disclosure belongs to the technical field of fans, and in particular, to an air guide frame, a fan head, and a handheld concentrating fan.

BACKGROUND

A fan is often used for cooling in hot weather. A handheld fan is a portable fan having a small volume and a small overall weight, and grid lines of a mains supply may not restrain usage scenarios of the handheld fan. The handheld fan is powered by a built-in battery and is provided with a component convenient for being held by a user, so that a requirement for portability can be met to an extent.

However, blades of an existing fan have low blowing efficiency. An air flow is easily dispersed after being blown out of the fan, so that the fan cannot blow the air flow farther. During actual use, a user can feel cool when the user gets close to an air outlet of the fan. Once the user gets far away from the fan, the wind strength decreases because of the dispersion of the air flow. Consequently, the cooling effect is poorer, which greatly affects an actual user experience.

SUMMARY

The present disclosure aims to provide an air guide frame, a fan head, and a handheld concentrating fan for defects and shortcomings in the existing technology, having the advantages that internal air blown out by the fan head can drive external air to be blown farther by arranging fan blades into special shapes and arranging an air outlet into two air channels.

In order to achieve the above objectives, in a first aspect, a technical solution used in the present disclosure is as follows: an air guide frame is configured to: be arranged at an air outlet of a fan head and guide air from a fan; the air guide frame includes an inner frame and a separator ring arranged at a periphery of the inner frame; a first air channel is formed in a periphery of the separator ring; a second air channel is formed between the inner frame and the separator ring; and a wind speed of wind exported from the second air channel is greater than a wind speed of wind exported from the first air channel.

Compared with the existing technology, the air guide frame provided in the present disclosure having the first air duct and the second air duct can implement wind speeds of winds blown out through the two air ducts being different, and winds with different wind speeds and angles collide with each other to form turbulent wind, thus blowing the wind farther, making a user feel more comfortable, and enhancing a blowing effect.

In one embodiment, the air guide frame further includes a frame body; the frame body is arranged at the periphery of the separator ring; and the first air channel is located between the frame body and the separator ring.

In one embodiment, the air guide frame further includes a first grille; the first grille is arranged in the first air channel; the air guide frame further includes a second grille; the second grille is arranged in the second air channel; and the length of the first grille in the air guide direction of the first air channel is greater than the length of the second grille in the air guide direction of the second air channel.

In one embodiment, a plurality of first grilles and a plurality of second grilles are provided, and a quantity of the first grilles is greater than or equal to a quantity of the second grilles.

In one embodiment, the first grille is connected between the frame body and the separator ring; the second grille is connected between the separator ring and the inner frame; and the frame body, the first grille, the separator ring, the second grille, and the inner frame are integrally formed.

In one embodiment, a surface of the inner frame enclosed into the second air channel is tilted relative to an air exiting direction of the second air channel, so that an outer diameter of the inner frame gradually increases in the air exiting direction of the second air channel.

According to a second aspect, the present disclosure further provides a fan head. An air inlet and an air outlet are provided in the fan head; a fan and a driving assembly of the fan are arranged between the air inlet and the air outlet; and the air outlet is provided with the air guide frame. By using the air guide frame, the fan head also has the beneficial effects of the air guide frame, so that wind speeds of winds blown out through the two air ducts are different, and winds with different wind speeds and angles collide with each other to form turbulent wind, thus blowing the wind farther, making a user feel more comfortable, and enhancing a blowing effect.

In one embodiment, the fan includes a hub and at least two blades arranged in a circumferential direction of the hub; each blade includes a first fan blade and a second fan blade; the first fan blade is connected to the hub; the second fan blade is connected to the end of the first fan blade that is away from the hub; the second fan blade corresponds to the first air channel; and the first fan blade corresponds to the second air channel.

In one embodiment, an angle is provided between planes or curved surfaces on which the same side surfaces of the first fan blade and the second fan blade are located; the first fan blade is a first forward swept blade region; the second fan blade is a second forward swept blade region or forward blade region; and a forward-sweep angle of the first forward swept blade region is greater than a forward-sweep angle of the second forward swept blade region or forward blade region.

In one embodiment, the fan head further includes a rear cover arranged at the end near the air inlet; the side of the rear cover that is away from the air inlet abuts against the air guide frame and is covered outside the fan and the driving assembly together with the air guide frame; the diameter of the end of the rear cover that is near the air inlet is less than the diameter of the end of the rear cover that is away from the air inlet; and the diameter of the end of the air guide frame that is near the air outlet is less than the diameter of the end of the air guide frame that is away from the air outlet.

In one embodiment, the fan head further includes a front frame and a rear frame; the front frame is detachably connected to the rear frame; the front frame and the rear frame are enclosed to form a cavity; the fan, the driving assembly, the air guide frame, and the rear cover are all arranged in the cavity; the air inlet is arranged at the end of the rear frame that is away from the front frame; and the air outlet is arranged at the end of the front frame that is away from the rear frame.

In one embodiment, the rear cover is provided with an abutting rib; the abutting rib abuts against the rear frame; and the air guide frame is integrally formed with the front frame.

In one embodiment, the fan head further includes a decorative sheet; the decorative sheet is detachably covered at the end of the air guide frame that is away from the air inlet; the decorative sheet is provided with a bump and a positioning column; the air guide frame is provided with a clamping slot and a positioning hole; the positioning column is threaded inside the positioning hole; the bump and the clamping slot are detachably fastened; the decorative sheet is of a circular structure; and a central part protrudes towards the side away from the convex block.

In one embodiment, the fan further includes a connector; the connector connects the first fan blade to the second fan blade; and the connector is annularly arranged outside the hub; and a distance from the connector to the air inlet is less than a distance from the hub to the air inlet.

According to a third aspect, the present disclosure further provides a handheld concentrating fan, including the air guide frame, or the fan head. By using the air guide frame or the fan head, the handheld concentrating fan can implement wind speeds of winds blown out through the two air ducts being different, and winds with different wind speeds and angles collide with each other to form turbulent wind, thus blowing the wind farther, making a user feel more comfortable, and enhancing a blowing effect.

After the above technical solutions are used, the present disclosure have the beneficial effects.

1. By arranging the air inlet and the air outlet on the fan head and arranging the fan and the driving assembly of the fan are arranged between the air inlet and the air outlet, the fan includes the hub and the blades; the blades are divided into at least two regions in a radial direction of the hub; a region near the hub is the first forward swept blade region, and a region away from the hub is the second forward swept blade region or forward blade region. The forward-sweep angle of the first forward swept blade region is greater than the forward-sweep angle of the second forward swept blade region or forward blade region. Therefore, a wind pressure generated by the first forward swept blade region during rotation of the hub is greater than a wind pressure generated by the second forward swept blade region or forward blade region, to drive an air flow generated by the second forward swept blade region or forward blade region by an air flow generated by the first forward swept blade region, thereby prolonging a blowing distance of the entire fan.
2. Meanwhile, at least two air channels are arranged at the air outlet. One air channel corresponds to the first forward swept blade region to blow the air flow generated by the first forward swept blade region out of the fan head. The other air channel corresponds to the second forward swept blade region or pressure side region to blow the air flow generated by the second forward swept blade region or pressure side region out of the fan head, so that the air blows can be blown out through the fan head along the air channels. The air channels play a partitioning role and a guiding role on the air flows, and the guided air flows can be blown more intensively and farther.
3. Since the first air channel and the second air channel are arranged on the air guide frame, the wind speeds of the winds blown out through the two air channels are different, and the wind blown out through the first air channel and the wind blown out through the second air channel counteract with each other to form the turbulent wind, thus blowing the wind farther and making a user feel more comfortable.

BRIEF DESCRIPTION OF THE DRAWINGS

In order to explain the technical solutions of the embodiments of the present invention more clearly, the following will briefly introduce the accompanying drawings used in the embodiments. Apparently, the drawings in the following description are only some embodiments of the present invention. Those of ordinary skill in the art can obtain other drawings based on these drawings without creative work.

Figure 1:
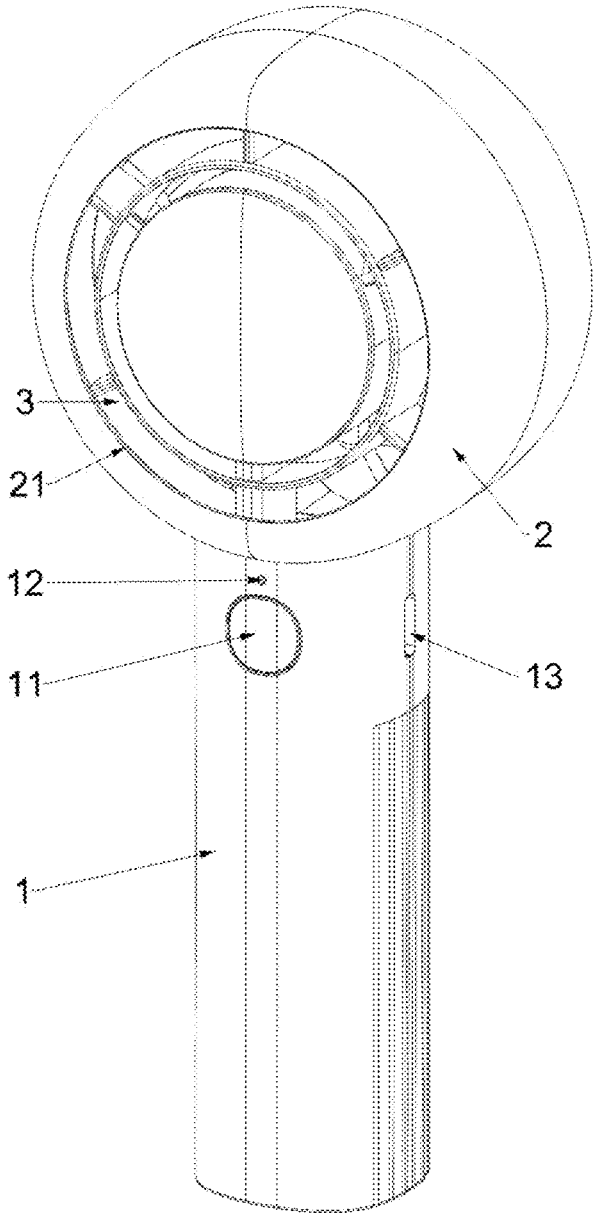
FIG. 1 is a three-dimensional diagram of a handheld concentrating fan according to Embodiment I of the present disclosure.

Descriptions of reference numerals: 1000: handheld concentrating fan; 1: grip; 101: front shell; 102: rear shell; 11: button; 12: indicator light; 13: charging port; 2: fan head; 201: front frame; 202: rear frame; 203: cavity; 21: air outlet; 22: fastener; 23: clamping block; 24: air inlet; 241: air inlet hole; 25: decorative sheet; 251: convex block; 252: positioning column; 3: air guide frame; 31: frame body; 32: first air duct; 321: first grille; 33: second air duct; 331: second grille; 34: separator ring; 35: wiring hole; 351: baffle plate; 352: bottom plate; 36: mounting barrel; 361: clamping lot; 362: positioning hole; 37: inner frame; 4: fan; 41: hub; 42: jack; 43: blade; 431: first forward swept blade region; 432: pressure side region; 433: first fan blade; 434: second fan blade; 5: rear cover; 51: abutting rib; 6: driving assembly; 61: motor; 7: control circuit board; 8: battery; α: forward-sweep angle of first forward swept blade region; β: forward-sweep angle of second forward swept blade region; γ: angle; 1000A: handheld concentrating fan; 2A: fan head; 4*a*: fan; 41*a*: hub; 43*a*: blade; 433*a*: first fan blade; 434*a*: second fan blade; 44*a*: connector; 1000B: handheld concentrating fan; 2B: fan head; 3*b*: air guide frame; 31*b*: frame body; and 201*b*: front frame.

DETAILED DESCRIPTION OF THE EMBODIMENTS

The present invention is further described below in detail in combination with the accompanying drawings and embodiments.

This specific embodiment is only an explanation of the present invention, and it is not a limitation to the present invention. After reading this specification, those skilled in the art can make modifications to this embodiment that do not create any contribution as needed, but the modifications shall be protected by the patent law within the scope of the claims of the present invention.

Referring to FIG. 1 to FIG. 16, an embodiment of the present disclosure provides a handheld concentrating fan 1000, including a fan head 2 and a grip 1 connected to the fan head 2. The fan head 2 includes a fan 4 and a driving assembly 6 connected to the fan 4. A control circuit board 7 and a battery 8 electrically connected to the control circuit board 7 are arranged inside the grip 1. The driving assembly 6 is electrically connected to the control circuit board 7.

Specifically, the battery 8 is preferably a rechargeable battery. A charging port 13 coupled with the control circuit board 7 is provided on the grip 1. The charging port 13 can be connected to an external power source to charge the battery 8 through the control circuit board 7. The control circuit board 7 in other embodiments can also be arranged inside the fan head 2.

According to the handheld concentrating fan 1000 provided in this embodiment of the present disclosure, a button 11 and at least one indicator light 12 are further arranged on the grip 1. The button 11 is configured to control output power of the driving assembly 6 to be adjusted step by step, and can also control turning on or turning off of the driving assembly 6. When two or more indicator lights 12 are provided, illumination of different quantities of indicator lights 12 can indicate a battery level of the battery or a level of the output power of the driving assembly 6.

The fan head 2 will be described in detail below.

Embodiment I

Figure 2:
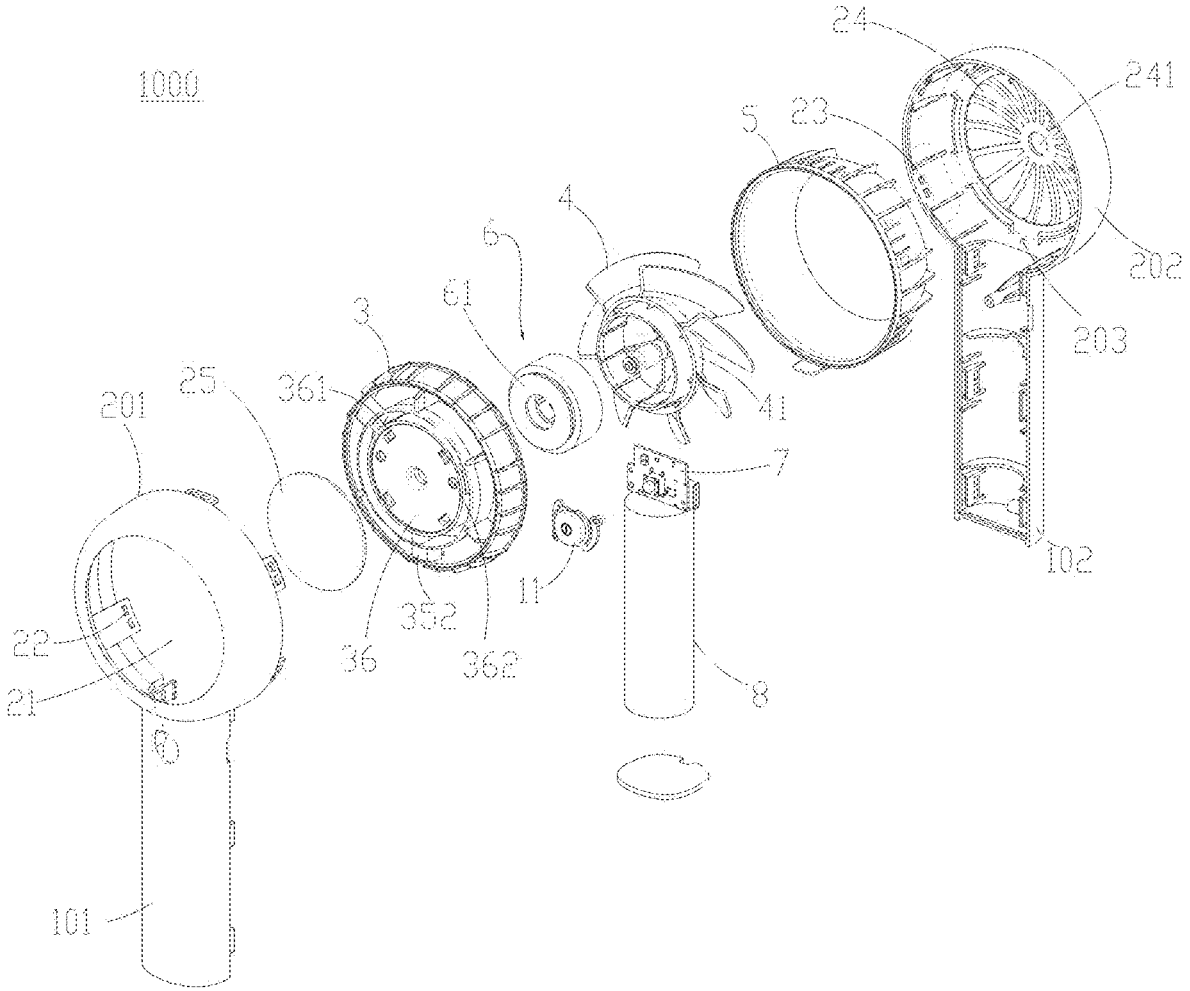
FIG. 2 is a schematic exploded view of the handheld concentrating fan shown in FIG. 1.
Figure 3:
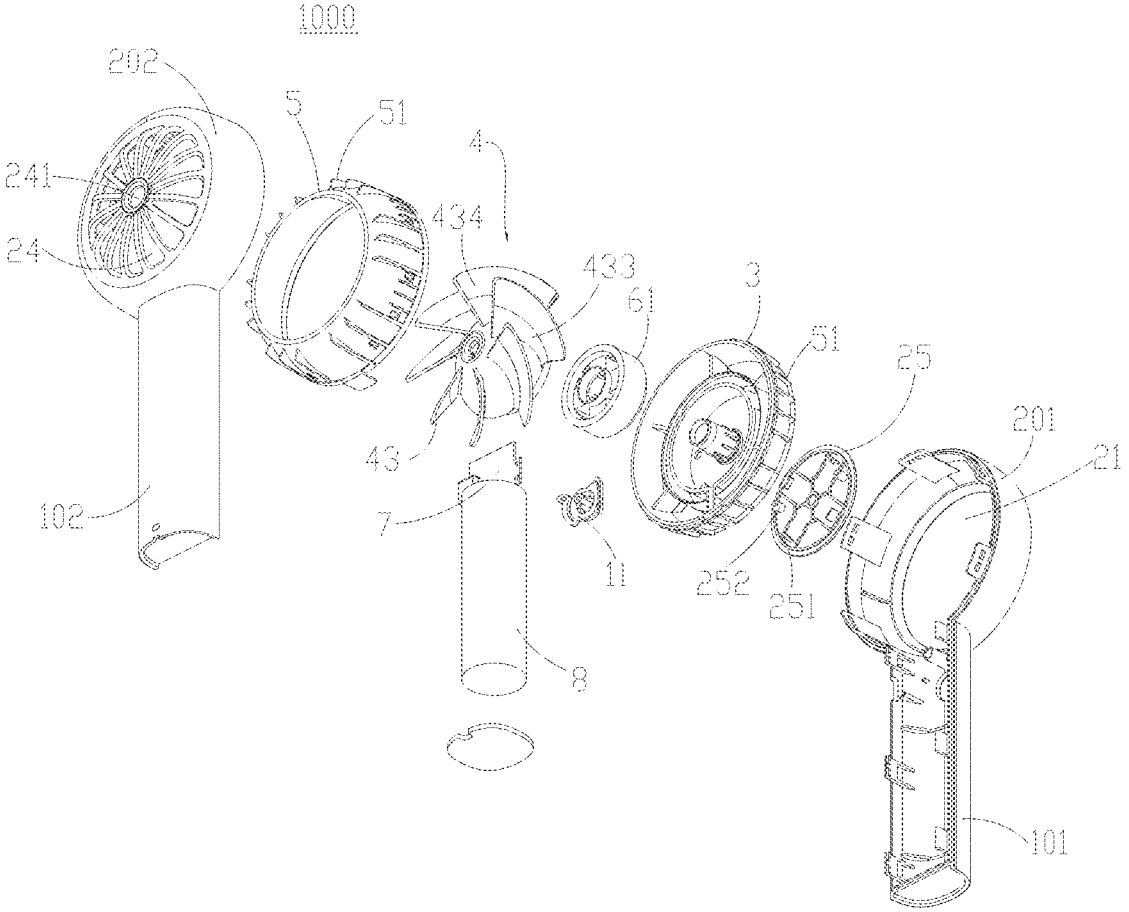
FIG. 3 is a schematic exploded view of the handheld concentrating fan shown in FIG. 1 in another angle.

This embodiment relates to a fan head 2. As shown in FIG. 1, FIG. 2, and FIG. 3, the fan head 2 is cylindrical. Specifically, the fan head 2 is assembled by a front frame 201 and a rear frame 202. A cavity 203 is formed between the front frame 201 and the rear frame 202. A fan 4 and a driving assembly 6 of the fan 4 are arranged inside the cavity 203. An air inlet 24 and an air outlet 21 are provided in the fan head 2. Specifically, the air outlet 21 is provided in the front frame 201, and the air inlet 24 is provided in the rear frame 202. The fan 4 and the driving assembly 6 of the fan 4 are arranged between the air inlet 24 and the air outlet 21, and both the air outlet 21 and the air inlet 24 are communicated to the cavity 203. The driving assembly 6 is configured to drive the fan 4 to rotate, to drive air to enter the cavity 203 through the air inlet 24 and then flow out through the air outlet 21, thereby forming an air flow or wind and playing a cooling role.

It should be noted that the front frame 201 and the rear frame 202 are detachably connected. Specifically, the front frame 201 is provided with a fastener 22, and the rear frame 202 is provided with a clamping block 23. The fastener 22 can be fastened with the clamping block 23, thus implementing fixed assembling of the front frame 201 and the rear frame 202 and then implementing connection without using a screw or glue. This improves assembling efficiency and reducing production costs. In a changed embodiment, the front frame 201 may be provided with a clamping block 23, and the rear frame 202 may be provided with a fastener 22, to implement the detachable connection between the front frame 201 and the rear frame 202. In other embodiments, the front frame 201 and the rear frame 202 are provided with screw holes, so that assembling is implemented by inserting a screw. Alternatively, the front frame 201 and the rear frame 202 are glued.

Preferably, the driving assembly 6 includes a motor 61. An output shaft of the motor 61 is connected to the fan 4 to drive the fan 4 to rotate. The fan 4 is a mixed-flow fan. The fan 4 includes a hub 41 and a plurality of blades 43 arranged in a circumferential direction of the hub 41. At least two blades 43 are included. The hub 41 is substantially of a conical structure. An insertion hole 42 is provided in a center line of rotation of the hub 41. The output shaft of the driving assembly 6 is plugged into the insertion hole 42, to cause the driving assembly 6 to drive the hub 41 to rotate. The rotation of the hub 41 drives the blades 43 to rotate, so that an air flow is induced from the air inlet 24 and is blown out towards the air outlet 21. The fan 4 in other embodiments is an axial flow fan. In this embodiment, there are seven blades 43 which are distributed in the circumferential direction of the hub 41. When the motor 61 is started, the output shaft drives the hub 41 to rotate, thereby driving the blades 43 to rotate, to form an air flow that flows out through the air outlet 21.

Referring to FIG. 2 to FIG. 6, in this embodiment, each blade 43 includes a first fan blade 433 and a second fan blade 434. The first fan blade 433 is connected to the hub 41, and the second fan blade 434 is connected to the end of the first fan blade 433 that is away from the hub 41. An angle γ is provided between planes or curved surfaces on which the same side surfaces of the first fan blade 433 and the second fan blade 434 are located. Specifically, in this embodiment, surfaces with relatively large areas of two sides of the first fan blade 433 and the second fan blade 434 are curved surfaces, and the angle γ is provided at a connection between the first fan blade 433 and the second fan blade 434. In other embodiments, surfaces with relatively large areas on two sides of the first fan blade and the second fan blade may be planes.

Figure 5:
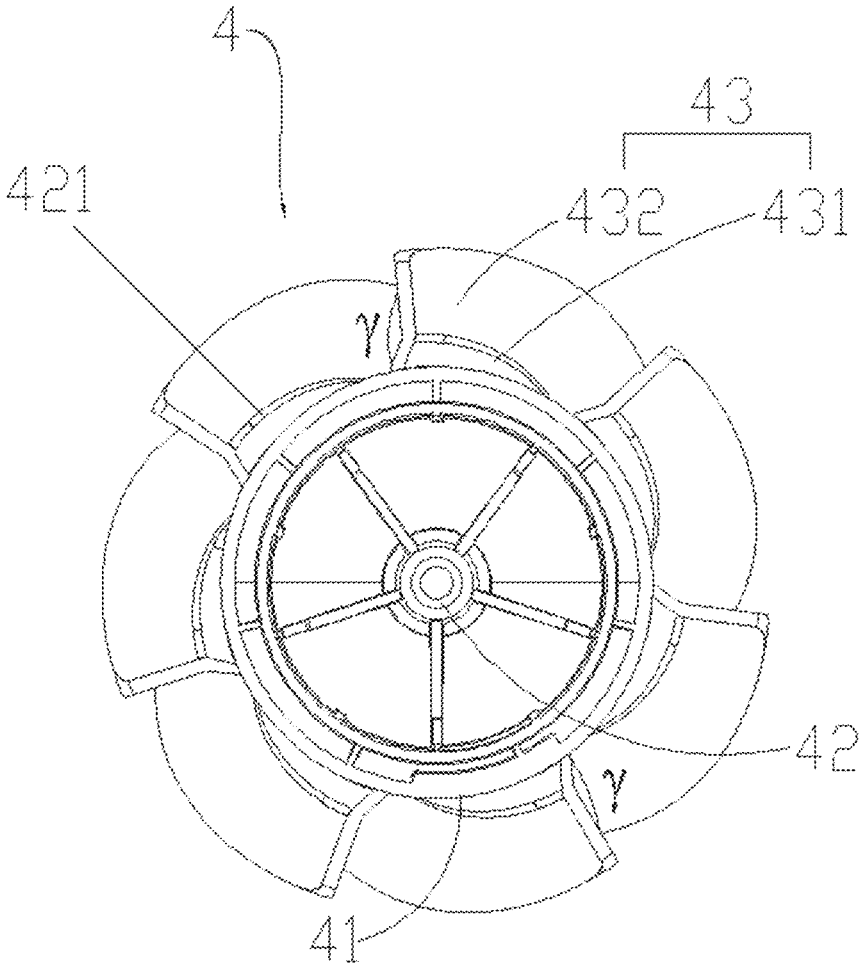
FIG. 5 is a schematic structural diagram of a fan of the handheld concentrating fan shown in FIG. 1.
Figure 6:
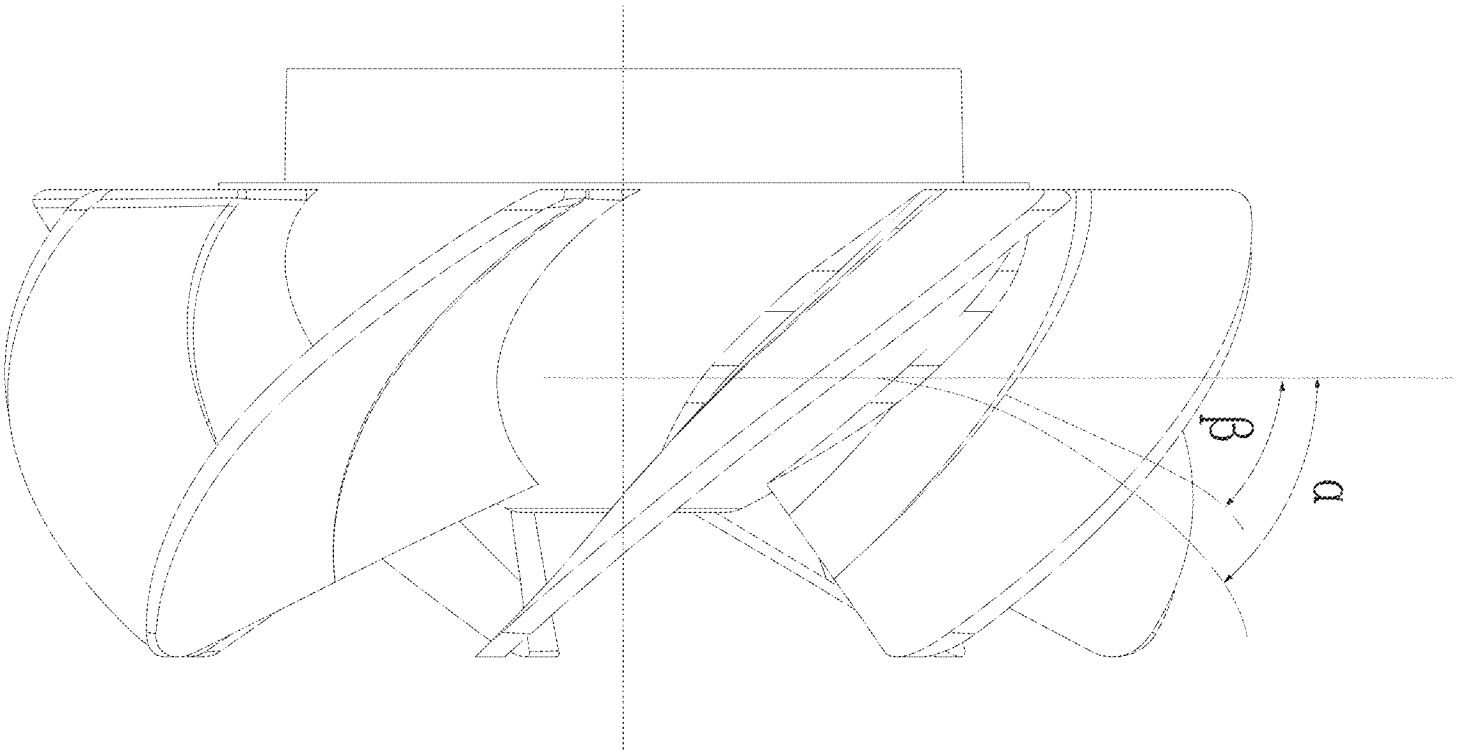
FIG. 6 is a schematic structural diagram of a fan of the handheld concentrating fan shown in FIG. 1 in another angle.

As shown in FIG. 5 and FIG. 6, each blade 43 is divided into at least two regions in a radial direction of the hub 41. The two regions are connected to each other, and an angle is formed between the two regions. One region near the hub 41 is a first forward swept blade region 431, and one region away from the hub 41 is a second forward swept blade region or forward blade region 432. A forward-sweep angle of the first forward swept blade region 431 is greater than a forward-sweep angle of the second forward swept blade region. That is, in this embodiment, the first fan blade 433 is the first forward swept blade region 431, and the second fan blade 434 is the second forward swept blade region or forward blade region 432. The forward-sweep angle α of the first forward swept blade region 431 is greater than the forward-sweep angle β of the second forward swept blade region or forward blade region 432. Therefore, a wind pressure generated by the first forward swept blade region 431 during rotation of the hub 41 is greater than a wind pressure generated by the second forward swept blade region or forward blade region 432, to drive an air flow generated by the second forward swept blade region or forward blade region 432 by an air flow generated by the first forward swept blade region 431, thereby prolonging a blowing distance of the entire fan 4. Referring to FIG. 3 and FIG. 5, the first fan blade 433 has an end surface 421 exposed between the first forward swept blade region 431 and the second forward swept blade region or forward blade region 432, so that at least part of the second fan blade 434 is staggered from the first fan blade 433, to allow the forward-sweep angle α of the first forward swept blade region 431 to be greater than the forward-sweep angle β of the second forward swept blade region or forward blade region 432.

As shown in FIG. 6, in this embodiment, a region away from the hub 41 is the forward blade region 432, and the blade in the forward blade region 432 is partially arranged in a forward-sweep manner with the hub 41. The forward-sweep angle α exists between the blade in the first forward swept blade region 431 and the hub 41, and the forward-sweep angle α has a range of 20-30°. In other embodiments, a region away from the hub 41 is the second forward swept blade region, and the forward-sweep angle β of the second forward swept blade region is less than the forward-sweep angle α of the first forward swept blade region 431. That is, the forward-sweep angle β of the second forward swept blade region is within a range of 10-19°.

In an existing handheld fan, only an air outlet structure is simply provided, but wind generated by the fan is not guided. As a result, a wind direction of wind blown by the handheld fan is chaotic, and the wind is easily dispersed, leading to a short blowing distance and less concentrated wind force of the fan and causing a poor blowing experience for a user.

Figure 4:
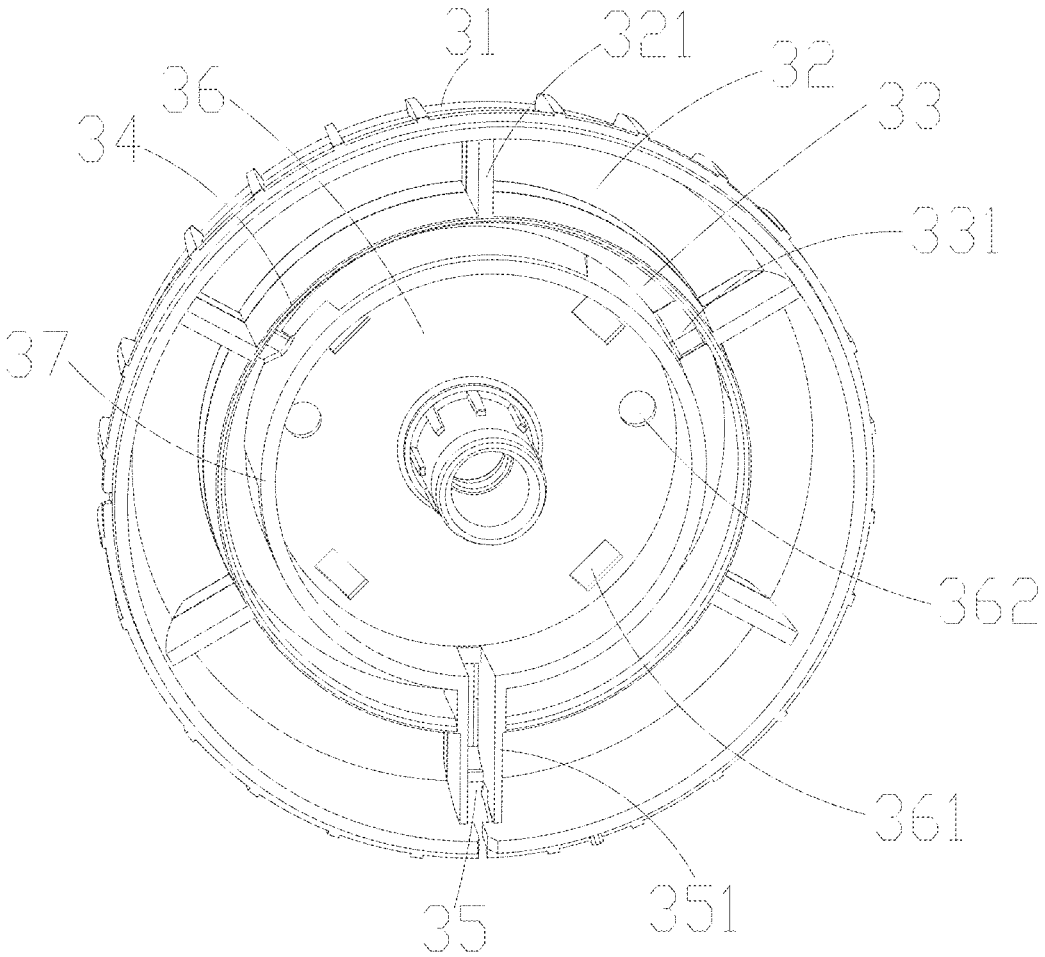
FIG. 4 is a schematic structural diagram of an air guide frame of the handheld concentrating fan shown in FIG. 1.

Referring to FIG. 4, in order to make the blown wind more comfortable and achieve a longer blowing distance, at least two air channels are arranged at the air outlet 21. One air channel corresponds to the first front swept blade region 431, to allow the air flow generated by the first front swept blade region 431 to pass through. This air channel is a second air channel 33. The other air channel is a first air channel 32. The first air channel 32 corresponds to the second forward swept blade region or forward blade region 432, to allow the air flow generated by the second forward swept blade region or forward blade region 432 to pass through. It can be understood that the first fan blade 433 corresponds to the second air channel 33, and the first fan blade 433 drives a second air flow to flow through the second air channel 33 and then out through the air outlet 21. The second fan blade 434 corresponds to the first air channel 32, and the second fan blade 434 drives a first air flow to flow through the first air channel 32 and then out through the air outlet 21. Specifically, a wind speed of the first air flow blown out through the first air channel 32 is less than a wind speed of the second air flow blown out through the second air channel 33. By the arrangement of the first fan blade 433 and the second fan blade 434, during rotation, the fan 4 can drive air to form the second air flow and the first air flow that have different air pressures, so that the second air flow and the first air flow are concentrated to different extends and have different wind speeds. Thus, winds that are blown out through the two air channels and have different wind speeds and angles counteract with each other to form turbulent wind, thus blowing the wind farther and making a user feel comfortable.

The first air channel 32 and the second air channel 33 are both ringlike. The diameter of the first air channel 32 is greater than the diameter of the second air channel 33, and the first air channel 32 is annularly arranged on an outer ring of the second air channel 33. After the high-pressure air flow generated by the first forward swept blade region 431 is blown out through the second air channel 33, the straight air flow blown out of the forward blade region 432 is blown out through the first air channel 32. In this case, the high-pressure air flow can drive the straight air flow to be blown farther, thereby reducing dispersion of the air flow caused by a distance limitation and improving an actual user experience.

As shown in FIG. 4, an air guide frame 3 is arranged at the air outlet 21. The air guide frame 3 is ringlike. An outer ring of the air guide frame 3 abuts against the front frame 201 of the fan head 2. Specifically, a plurality of abutting ribs 51 can be arranged on the outer ring of the air guide frame 3. The abutting ribs 51 can enlarge the contact area between the air guide frame 3 and the front frame 201. After abutment, the air guide frame 3 can reduce transferring of vibrations generated by the fan 4 during the rotation to the front frame 201. This indirectly reduces noise. The first grille 321 is parallel to the direction of the air flow blown by the fan 4, and the second grille 331 is tilted relative to the direction of the air flow blown by the fan 4.

Figure 7:
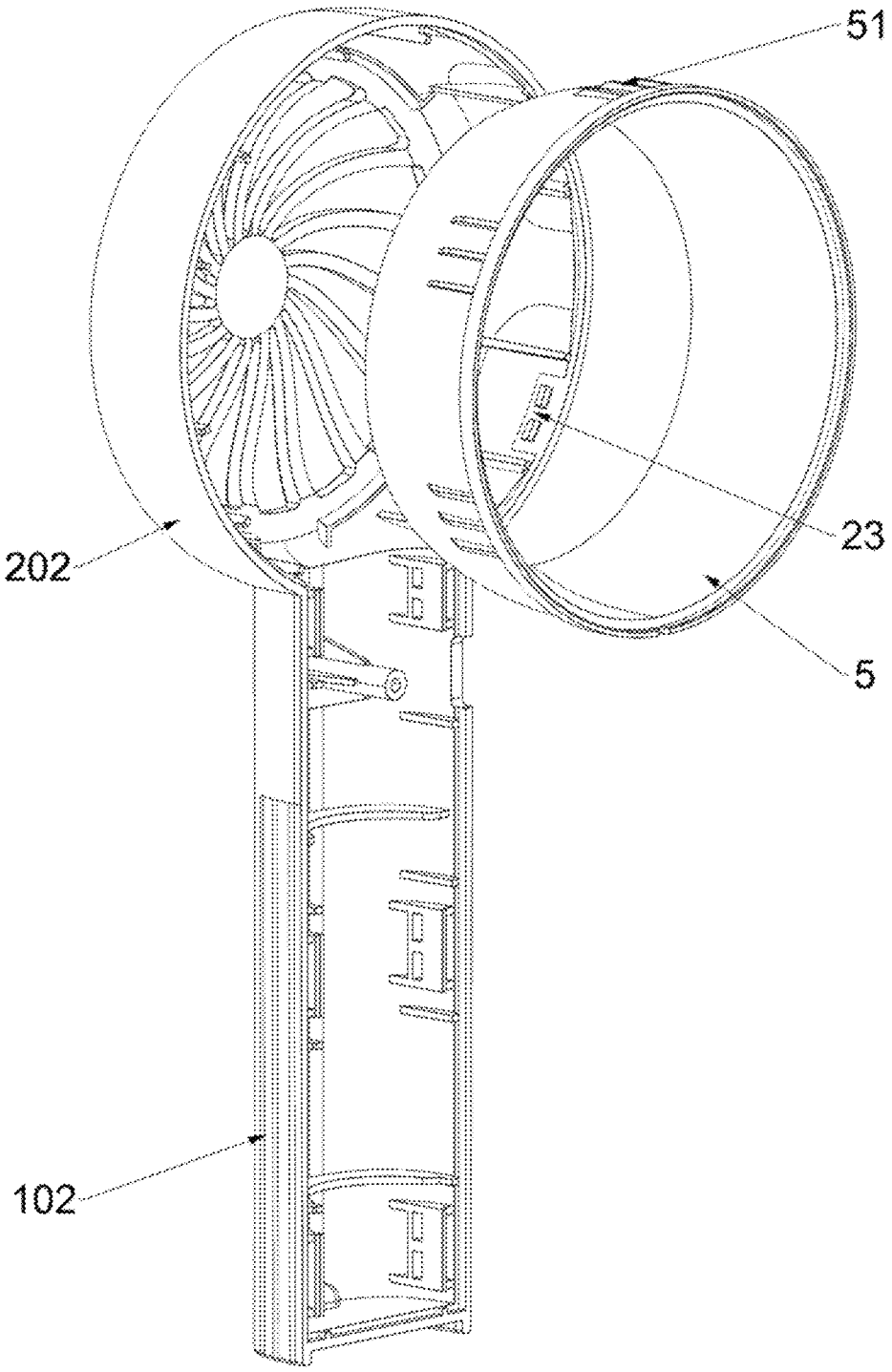
FIG. 7 is a schematic partially structural diagram of the handheld concentrating fan shown in FIG. 2.
Figure 8:
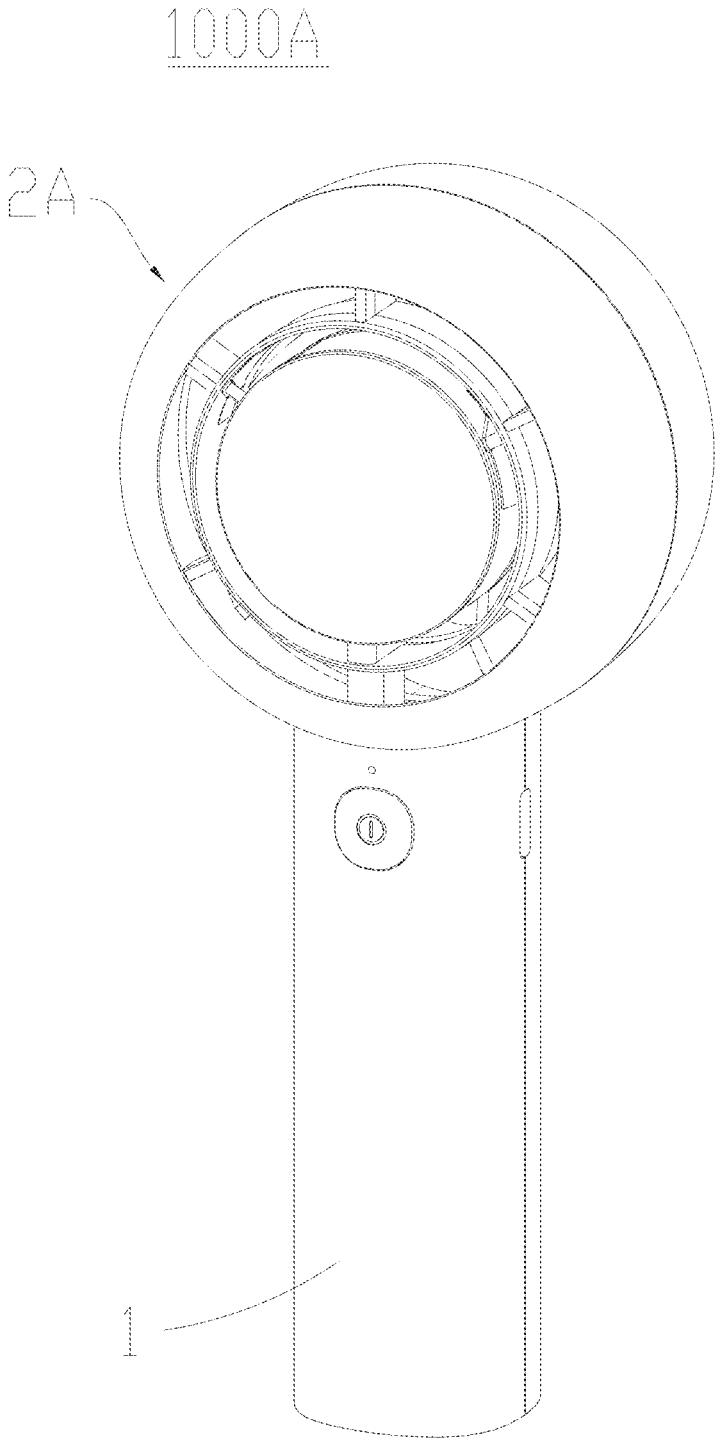
FIG. 8 is a three-dimensional diagram of a handheld concentrating fan according to Embodiment II of the present disclosure.
Figure 9:
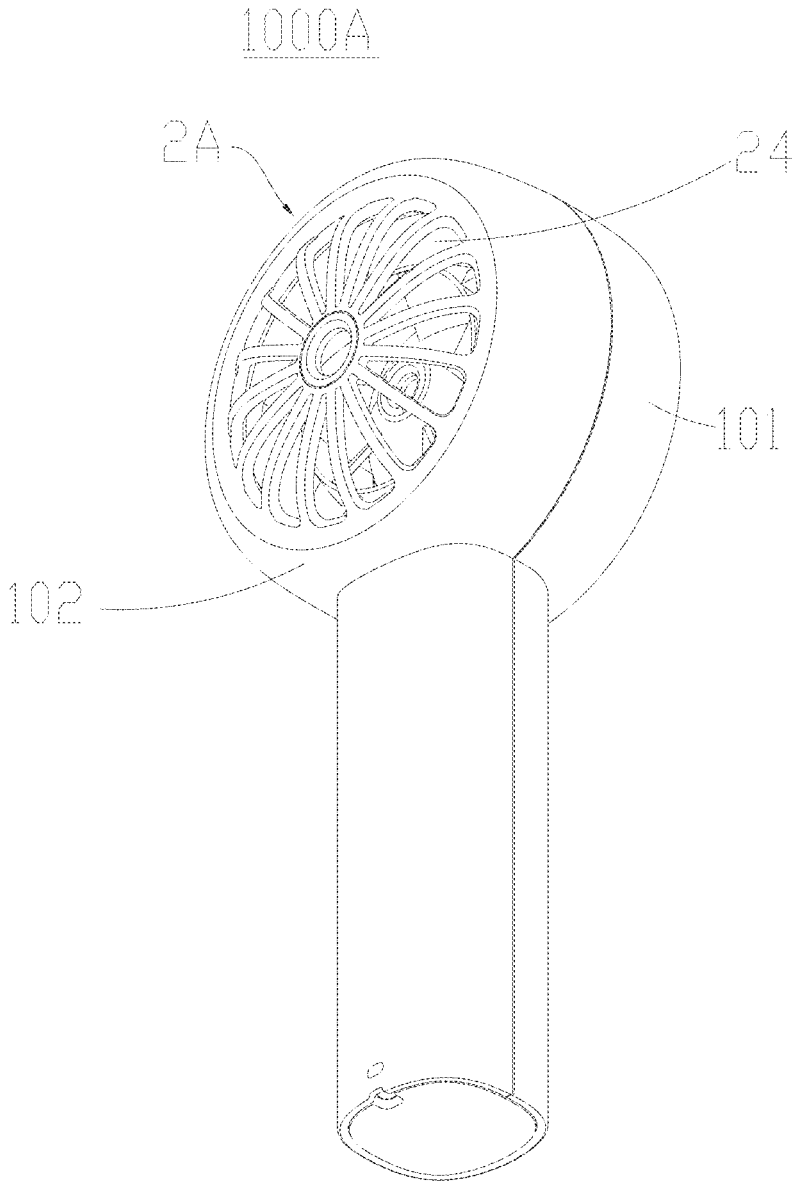
FIG. 9 is a three-dimensional diagram of the handheld concentrating fan shown in FIG. 8 in another angle.

As shown in FIG. 7, a rear cover 5 is assembled on the air inlet 24. The rear cover 5 is ringlike. A plurality of abutting ribs 51 for abutting against the rear frame 202 are also arranged on an outer side surface of the rear cover 5, so that the rear cover 5 reduces transferring of vibrations generated by the fan 4 during the rotation to the front frame 201. This indirectly reduces noise. Meanwhile, an inner side surface of the rear cover 5 is arc-shaped. The rear cover 5 can abut against the air guide frame 3, thereby wrapping around a side surface of the fan 4 and a side surface of the driving assembly, which can reduce a turbulent flow phenomenon caused by the air flow on irregular surfaces of the front frame 201 and the rear frame 202.

Specifically, the diameter of the end of the rear cover 5 that is near the air inlet 24 is less than the diameter of the end of the rear cover 5 that is away from the air inlet 24. The diameter of the end of the air guide frame 3 that is near the air outlet 21 is less than the diameter of the end of the air guide frame 3 that is away from the air outlet 21. The structural design of the rear cover 5 can pressurize and push air by the fan 4, thereby generating an air flow with a flow velocity that flows out from the air outlet 21.

Continuing to refer to FIG. 4, it should be added that the air guide frame 3 includes a frame body 31. An inner ring of the air guide frame 3 is connected with a separator ring 34. A first air channel 32 is formed between the frame body 31 of the air guide frame 3 and the separator ring 34, and a second air channel 33 is formed on the inner ring of the separator ring 34. Specifically, an inner frame 37 is arranged on the inner ring of the separator ring 34, and the second air channel 33 is formed between the inner frame 37 and the separator ring 34. Specifically, the air guide frame 3 can cause a wind speed of wind blown out through the first air channel 32 to be less than a wind speed of wind blown out through the second air channel 33. That is, the wind speed of the wind exported from the second air channel 33 is greater than the wind speed of the wind exported from the first air channel 32. Thus, the wind speed of the wind blown out from the first air channel 32 is relatively low and changes a little, while the wind speed of the wind exported from the second air channel 33 is relatively high and changes a little. When the two winds coubteract, turbulent wind is formed, so that the wind can be blown farther, and a user feels more comfortable. The air guide frame 3 implements the design of two air channels, has a simple structure, low costs, blows the wind farther, provides a more comfortable feeling, and enhances a cooling effect.

In other embodiments, the inner ring of the separator ring 34 is further connected with a separator loop, so that the second air channel 33 is formed between the separator ring 34 and the separator loop, and a third air channel is formed inside the separator loop. Meanwhile, a third forward swept blade region is also arranged between the first front swept blade region 431 on the fan 4 and the hub 41. The third forward swept blade region corresponds to the third air channel. A front-sweep angle of the third front swept blade region is different from the front-sweep angle of the first front swept blade region 431. A fourth air channel or a fifth air channel can also be arranged outside the air guide frame 3, and a quantity of air channels and a quantity of forward swept blade regions are not limited.

Preferably, the inner ring of the separator ring 34 is connected with a mounting barrel 36. The mounting barrel 36 is cylindrical, with its opening facing the air inlet 24. The opening of the mounting barrel 36 can be used for mounting and fixing the driving assembly 6. An outer side of the mounting barrel 36 is connected to the inner frame 37. In this embodiment, the second air channel 33 is arranged between the mounting barrel 36 and the separator ring 34, so an air output volume of the first air channel 32 is greater than an air output volume of the second air channel 33.

It should be added that a plurality of first grilles 321 are connected between the frame body 31 of the air guide frame 3 and the separator ring 34, and a plurality of second grilles 331 are connected between the separator ring 34 and the inner frame 37. The first grilles 321 and the second grilles 331 can allow the separator ring 34 and the inner frame 37 to be arranged at the air outlet 21 of the air guide frame 3. Meanwhile, the length of each first grille 321 in the direction from the air inlet 24 to the air outlet 21 is greater than the length of each second grille 331 in the direction from the air inlet 24 to the air outlet 21, so the air flow passing through the first grilles 321 can be more straight than the air flow passing through the second grilles 331. The first grilles 321 are located in the first air channel 32, and the second grilles 331 are located in the second air channel 33. The first grilles 321 extend in a flow direction of the first air flow in the first air channel 32, and an extension direction of the second grilles 331 in the second air channel 33 is intersected with the flow direction of the first air flow. The first grilles 321 are relatively long, so that the first air flow plays a guiding role when passing through the first air channel 32, to cause the first air flow to flow in a preset direction. Since the second air flow has a relatively high and is more concentrated, the second grilles 331 are relatively short, which can avoid the impact on the flow velocity of the second air flow.

Specifically, in this embodiment, five first grilles 321 and two second grilles 331 are included. The arrangement of the first grilles 321 and the second grilles 331 implements the connection of the components of the air guide frame 3, making the structure of the air guide frame 3 more stable.

Preferably, the first grilles 321 are parallel to the direction of the air flow blown by the fan 4, that is, the air flow blown by the fan 4 remains straight through the first grilles 321 and is blown out from the air outlet 21. The second grilles 331 are tilted relative to the direction of the air flow blown by the fan 4, that is, the air flow blown by the fan 4 is tilted through the second grilles 331 and is rotatably blown out from the air outlet 21. Thus, the high-pressure air flow for rotation drives the straight air flow to be blown farther.

In other embodiments, the first grilles 321 are tilted relative to the direction of the air flow blown by the fan 4, or the second grilles 331 are parallel to the direction of the air flow blown by the fan 4 and can be tilted or vertical according to different usage needs. For example, to reduce noise, the second grilles 331 are parallel to the direction of the air flow blown by the fan 4.

The width of the end of the first air channel 32 that is away from the air outlet 21 is greater than the width of the end of the first air channel 32 that is near the air outlet 21. The width of the end of the second air channel 33 that is away from the air outlet 21 is less than the width of the second air channel 33 that is near the air outlet 21. That is, the cross-sectional area of the first air channel 32 decreases in the direction from the air inlet 24 to the air outlet 21, which not only facilitates demolding, but also gradually concentrates the first air flow when the first air flow flows from the first air channel 32 to the air outlet 21, thus avoiding scattering of the air flow and making the air flow more concentrated, to blow the wind farther. The cross-sectional area of the side of the second air channel 33 that is near the fan is greater than or equal to the cross-sectional area of an air outlet side of the second air channel 33, which allows the second air flow to be in contact with the first air flow after flowing out of the air outlet 21, thereby driving the first air flow to flow farther. Due to the design of the widths of the air channels, it is convenient to demold the air guide frame 3 during production, thereby improving production efficiency and yield. Specifically, a surface of the inner frame 37 enclosed into the second air channel 33 is tilted relative to an air exiting direction of the second air channel 33, so that an outer diameter of the inner frame 37 gradually increases in the air exiting direction of the second air channel 33 and the air exiting direction gradually becomes uniform.

Specifically, in this embodiment, the frame body 31, the first grilles 321, the separator ring 34, the second grilles 331, and the inner frame 37 are integrally formed, which facilitates production and assembling while ensuring strength of the air guide frame 3.

In order to make the appearance of the product neater and more beautiful, the fan head 2 further includes a decorative sheet 25. The decorative sheet 25 is detachably covered at the end of the air guide frame 36 that is away from the air inlet 24. The decorative sheet 25 is provided with a convex block 251 and a positioning column 252. The mounting barrel 36 is provided with a clamping slot 361 and a positioning hole 362. The positioning column 252 is threaded inside the positioning hole 362. The bump 251 and the clamping slot 361 are detachably fastened. To ensure strength, the decorative sheet 25 is of a circular structure, and a central part protrudes towards the side away from the bump 251. The arrangement of the decorative sheet 25 makes the appearance of the product more beautiful and tidier, and it is convenient for assembling by the detachable connection.

This embodiment relates to a handheld concentrating fan 1000. As shown in FIG. 1 to FIG. 7, the handheld concentrating fan 1000 is provided with the fan head 2, and a grip 1 is arranged at a bottom of the fan head 2. The grip 1 is specifically composed of a front shell 101 and a rear shell 102. The front shell 101 corresponds to the front frame 201 of the fan head 2, and the rear shell 102 corresponds to the rear frame 202 of the fan head 2. The front shell 101 and the rear shell 102 are also assembled through a fastener 22 and a clamping block 23.

In this embodiment, the front shell 101 and the front frame 201 are integrally formed, and the rear shell 102 and the rear frame 202 are integrally formed. The front shell 101 is communicated to the front frame 201, and the rear shell 102 is communicated to the rear frame 202. In other embodiments, the front shell 101 is in snap-in assembling with the front frame 201, and the rear shell 102 is also in snap-in assembling with the rear frame 202. The snap-in assembling can be implemented through positioning blocks that are mutually clamped.

Preferably, a control circuit board 7 and a battery 8 coupled with the control circuit board 7 are arranged inside the grip 1. The battery 8 can supply power to the driving assembly 6 through the control circuit board 7, and can also supply power to other electronic components coupled with the control circuit board 7. The battery 8 is preferably a rechargeable battery. A charging port 13 coupled with the control circuit board 7 is provided on the grip 1. The charging port 13 can be connected to an external power source to charge the battery 8 through the control circuit board 7. The control circuit board 7 in other embodiments can also be arranged inside the fan head 2.

It should be added that other electronic components coupled with the control circuit board 7 include a button 11 and a plurality of indicator lights 12. The button 11 can control output power of the driving assembly 6 to be adjusted step by step, and can also control turning on or turning off of the driving assembly 6. Illumination of different quantities of indicator lights 12 can indicate a battery level of the battery 8 or a level of the output power of the driving assembly 6.

It should be added that a wiring hole 35 is further provided on the air guide frame 3. The wiring hole 35 extends from the outer ring of the air guide frame 3 directly to an inner wall of the mounting barrel 36. The control circuit board 7 and the driving assembly 6 are coupled through a wire, so the wire can be connected to the driving assembly 6 inside the mounting barrel 36 from the control circuit board 7 through the wiring hole 35. The design of the wiring hole 35 can implement more appropriate wiring.

Specifically, in order to make the appearance of the product more beautiful and tidier, the wiring hole 35 is formed by enclosing two opposite baffle plates 351 and a bottom plate 352. The baffle plates 351 and the bottom plate 352 are respectively connected to the frame body 31, the separator ring 34, and the mounting barrel 36, which can also increase strength of connection between the frame body 31, the separator ring 34, and the mounting barrel 36.

Compared with the existing technology, the fan head 2 provided in the present disclosure is provided with the first air ductair channel 32 and the second air ductair channel 33, and the second fan blades 434 and the first fan blades 433 are respectively arranged corresponding to the first air ductair channel 32 and the second air ductair channel 33. Furthermore, the angle is provided between the planes or curved surfaces on which the same side surfaces of the first fan blade 433 and the second fan blade 434 are located, so that a wind pressure generated by the second air flow driven by the first fan blade 433 during rotation is different from a wind pressure generated by the first air flow driven by the second fan blade 434, thereby making one of the air flows more concentrated and allowing the air flow flowing out of one air ductair channel to drive the air flow flowing out of the other air ductair channel to flow farther, to prolong a blowing distance of the fan head 2. Meanwhile, the design of the two air ductair channels allows the second air flow and the first air flow to flow in different air ductair channels, to play a diversion role and a guiding role, thereby making one air flow more concentrated and the other air flow softer. In addition, due to different flow velocities, the two air flows can collide with counteract with each other to form turbulent wind, thus blowing the wind farther and making a user feel more comfortable. In this embodiment, the second air flow blown out through the second air ductair channel 33 has a higher wind pressure, is more concentrated, and has a higher wind speed, so that the second air flow can be blown farther. The first air flow blown out through the first air ductair channel 32 surrounds the second air flow, is softer, and has a lower wind speed. Due to the design of the air ductair channel structures, after being blown out from the air outlet, the second air flow is in contact with the first air flow and can drive the first air flow to be blown farther.

Embodiment II

Referring to FIG. 8 to FIG. 12, Embodiment II provides a fan head 2A and a handheld concentrating fan 1000A using the fan head 2A.

A structure of the fan head 2A in Embodiment II is mostly the same as that of the fan head 2 in Embodiment I. In order to facilitate a quick understanding of differences in the fan head 2A in Embodiment II, the same structural parts will not be elaborated. The following will provide a detailed description of a difference in a fan 4*a* in the fan head 2A, and different numerals are used to distinguish different components. For the same structural parts, the numerals in Embodiment I will continue to be used.

Figure 10:
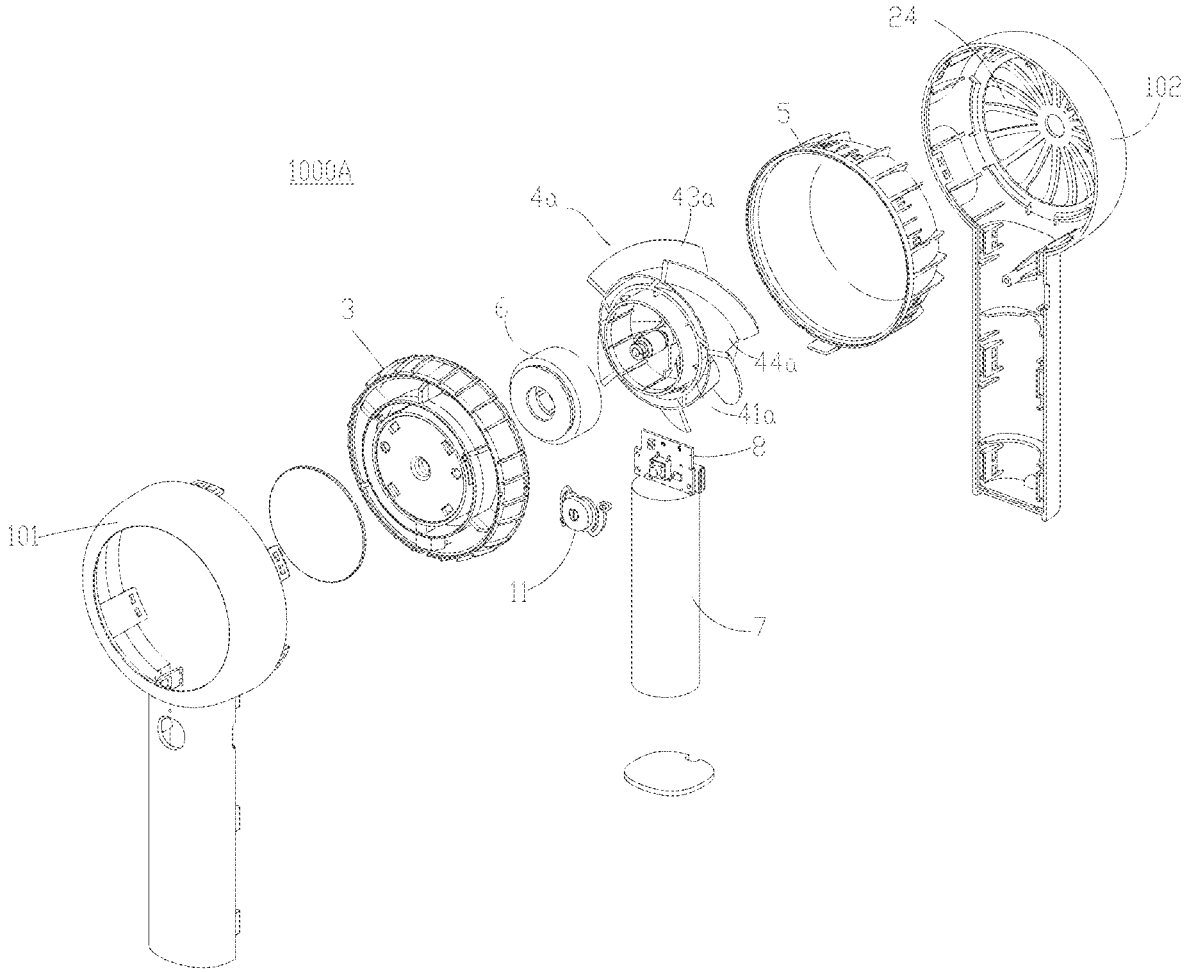
FIG. 10 is a schematic exploded view of the handheld concentrating fan shown in FIG. 8.
Figure 11:
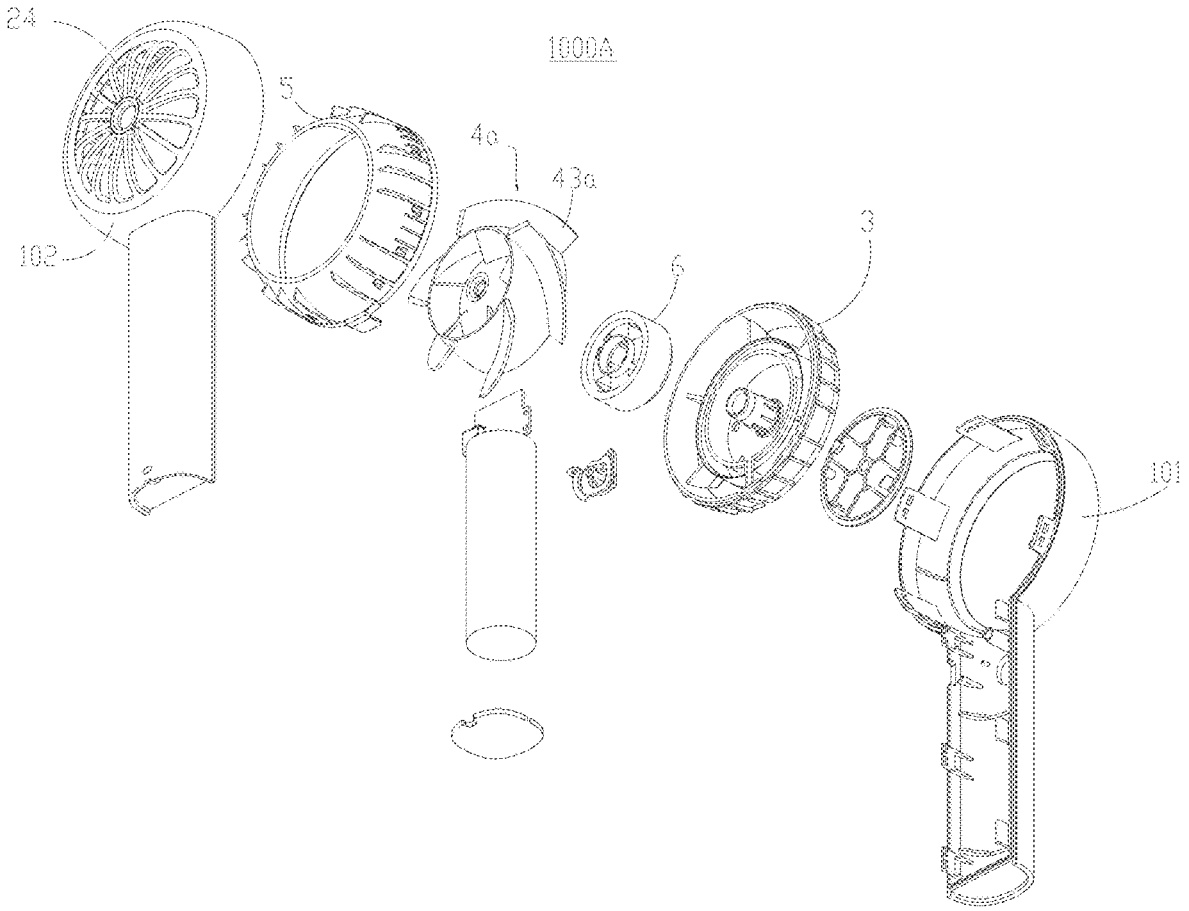
FIG. 11 is a schematic exploded view of the handheld concentrating fan shown in FIG. 8 in another angle.
Figure 12:
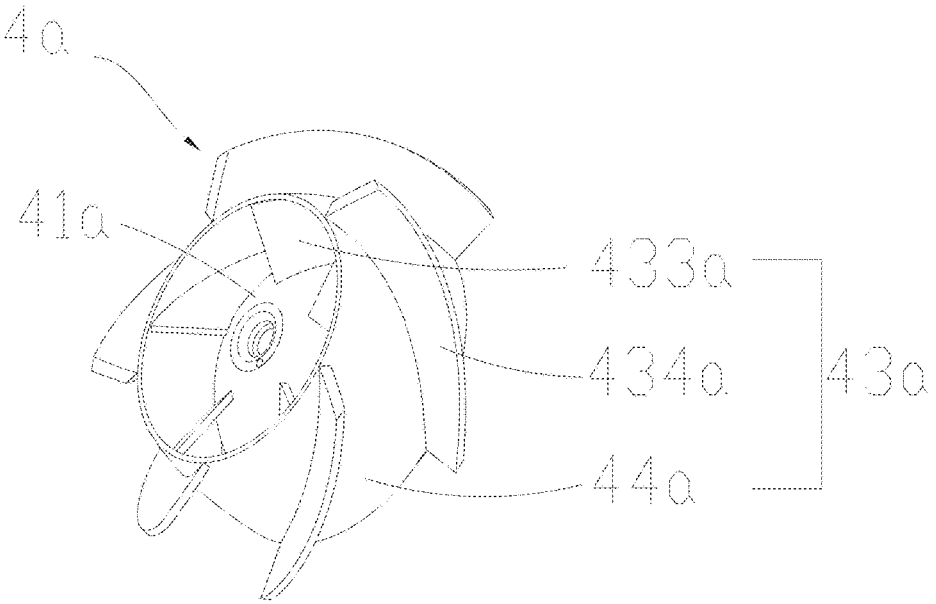
FIG. 12 is a schematic structural diagram of a fan of the handheld concentrating fan shown in FIG. 8.
Figure 13:
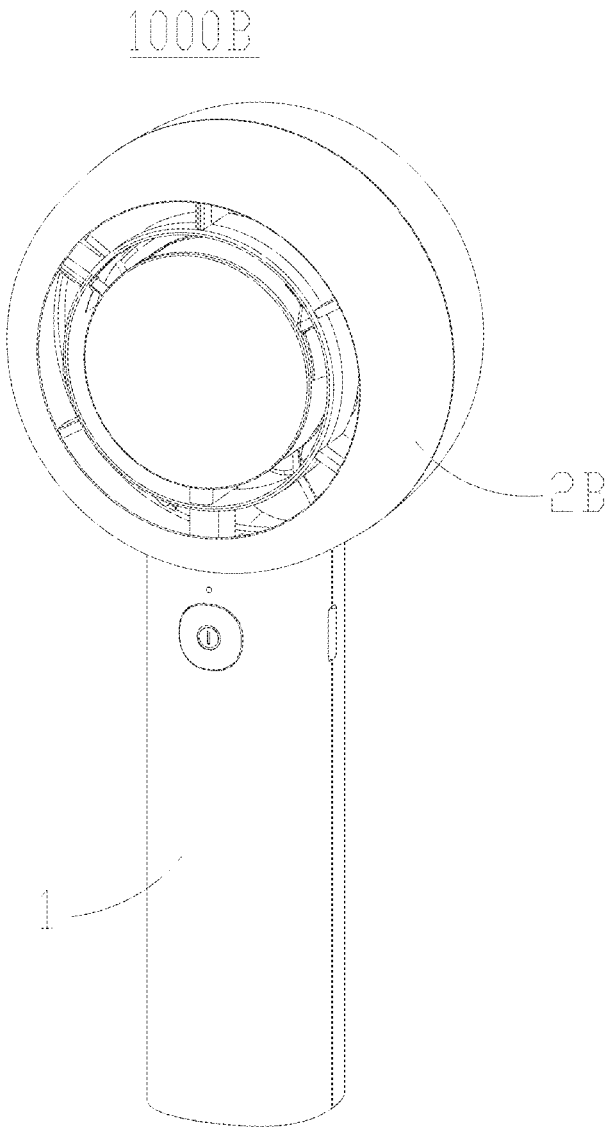
FIG. 13 is a three-dimensional diagram of a handheld concentrating fan according to Embodiment III of the present disclosure.
Figure 14:
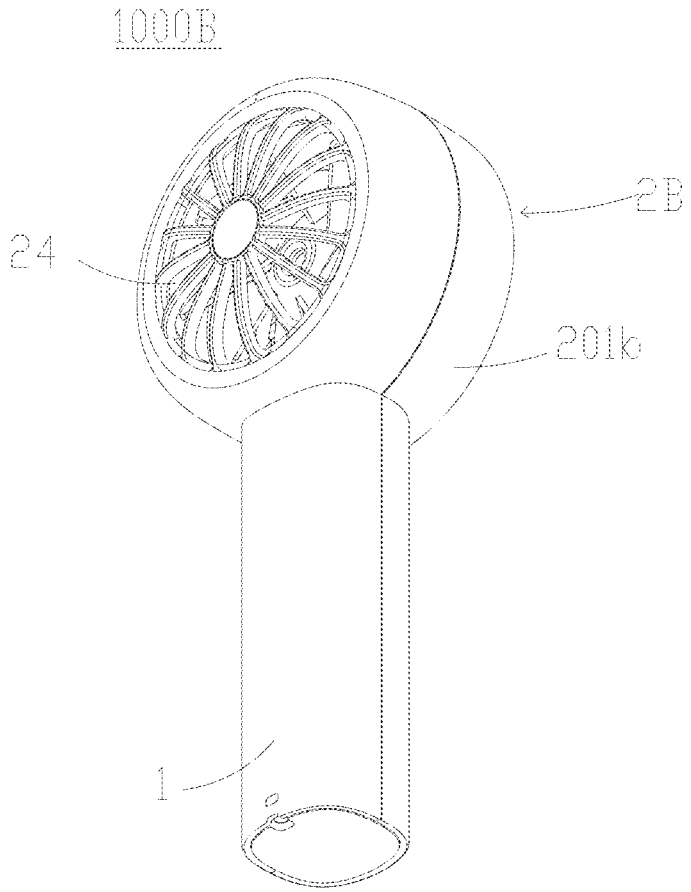
FIG. 14 is a three-dimensional diagram of the handheld concentrating fan shown in FIG. 13 in another angle.

Referring to FIG. 10 to FIG. 12, in this embodiment, the fan 4*a* includes a hub 41*b* and a plurality of blades 43*a* arranged in a circumferential direction of the hub 41*b*. Each blade 43*a* includes a first fan blade 433*a*, a second fan blade 434*a*, and a connector 44*a* that connects the first fan blade 433*a* to the second fan blade 434*a*. The connector 44*a* is approximately of a ringlike structure, which is annularly arranged outside the hub 41*a*. One end of the first fan blade 433*a* is connected to the hub 41*a*, and another end is connected to the connector 44*a*. The side of the connector 44*a* that is away from the first fan blade 433*a* is connected to the second fan blade 434*a*. The distance between the connector 44*a* and the air inlet 24 is less than the distance between the hub 41*a* and the air inlet 24. Specifically, the end of the connector 44*a* that is near the air inlet 24 extends beyond the end of the hub 41*a* that is near the air inlet 24. By the arrangement of the connector 44*a*, the blade 43*a* can have a more stable structure.

In this embodiment, the structures of other parts of the product are the same as those in Embodiment I and will not be elaborated.

It can be understood that the difference between this embodiment and Embodiment I is that in Embodiment I, the first fan blade 433 and the second fan blade 434 that are connected to the inside and outside are respectively used to provide different winds to the first air channel 32 and the second air channel 33, so that the second air channel 33 has a longer air blowing distance. In this embodiment, the two independent groups, namely, the first fan blades 433*a* on the inner side and the second fan blades 434*a* on the outer side, are respectively used to provide different winds to the first air channel 32 and the second air channel 33, so that the second air channel 33 has a longer air blowing distance. A design space for the two independent groups in this embodiment, namely, the first fan blades 433*a* on the inner side and the second fan blades 434*a* on the outer side, is higher than the design space for the fan blades in Embodiment I, so that the flexibility is higher.

Embodiment III

Referring to FIG. 13 to FIG. 16. Embodiment III provides another fan head 2B and a handheld concentrating fan 1000B using the fan head 2B.

A structure of the fan head 2B in Embodiment III is mostly the same as that of the fan head 2 in Embodiment I. In order to facilitate a quick understanding of differences in the fan head 2B in Embodiment III, the same structural parts will not be elaborated. The following will provide a detailed description of a difference in the fan head 2B, and different numerals are used to distinguish different components. For the same structural parts, the numerals in Embodiment I will continue to be used.

Figure 15:
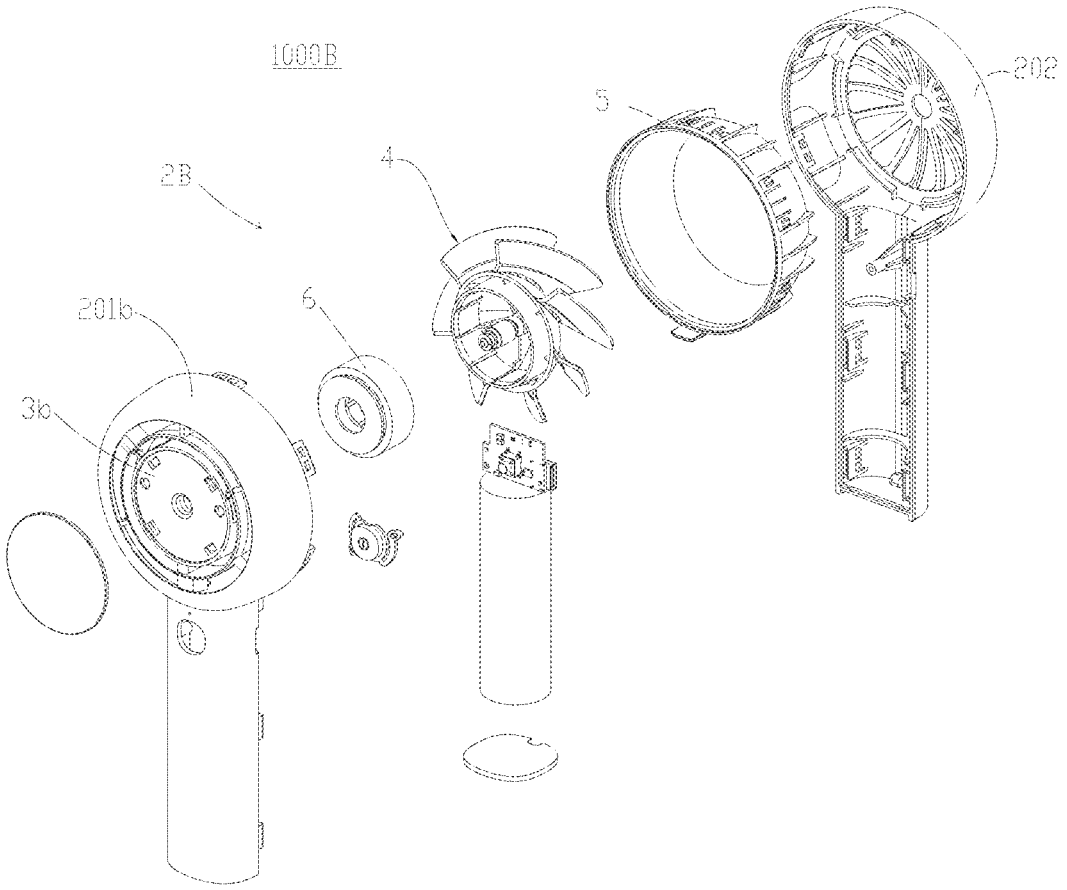
FIG. 15 is a schematic exploded view of the handheld concentrating fan shown in FIG. 13.
Figure 16:
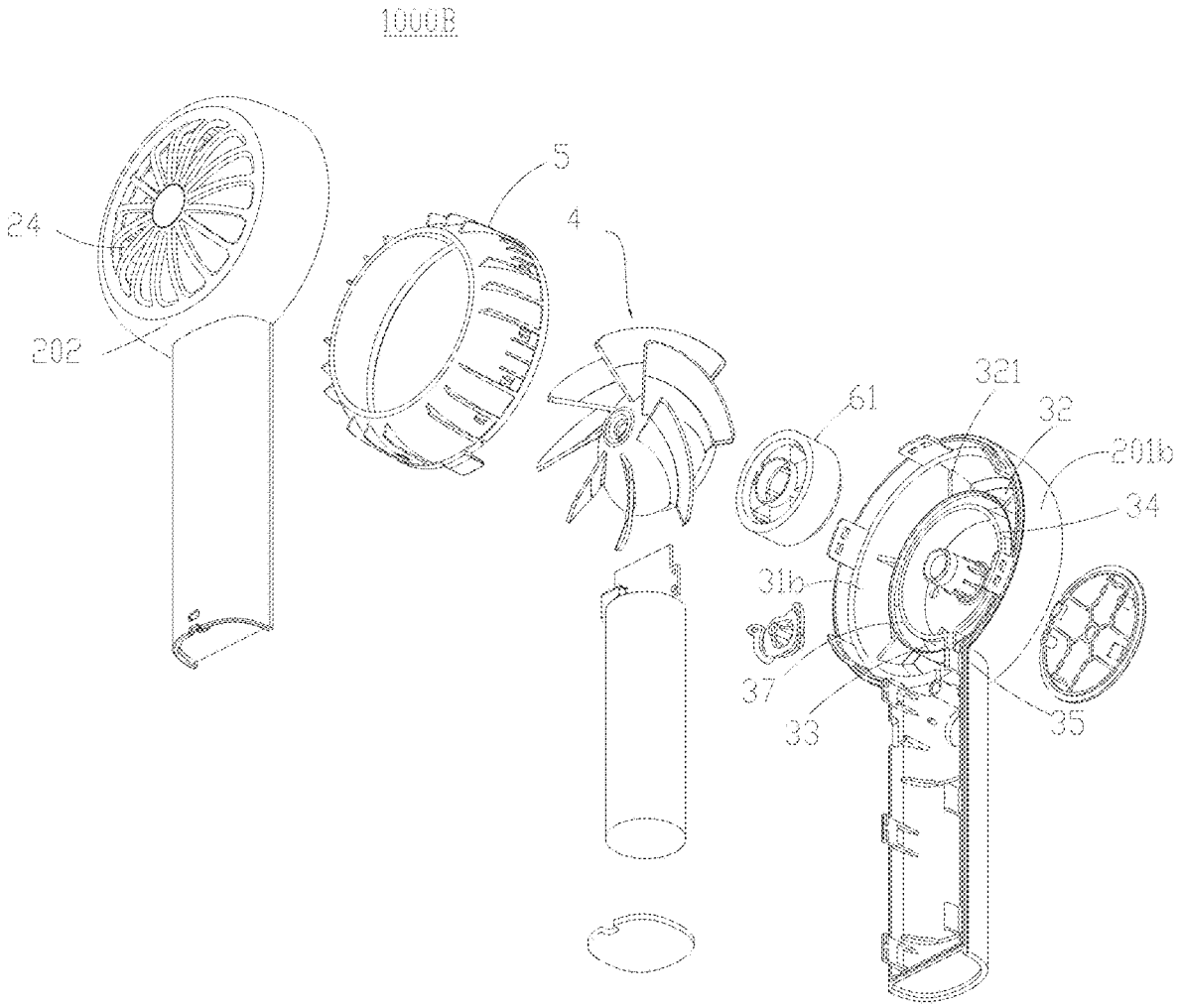
FIG. 16 is a schematic exploded view of the handheld concentrating fan shown in FIG. 15 in another angle.

Referring to FIG. 15 and FIG. 16, in Embodiment III, in order to facilitate production and assembling, improve assembling efficiency, and reduce assembling procedures, an air guide frame 3*b* and a front frame 201*b* are integrally formed, and a front frame 201*b* is covered outside the air guide frame 3*b*. Specifically, the frame body 31*b* and the front frame 201*b* are integrally formed, and the frame body 31*b* is located on an inner side of the front frame 201*b*. This can reduce one assembling procedure, improve the assembling efficiency, and reduce corresponding labor costs.

In this embodiment, the structures of other parts of the product are the same as those in Embodiment I and will not be elaborated.

The above descriptions are only preferred embodiments of the present invention, and are not intended to limit the patent scope of the present invention. Any equivalent structural transformation made by using the content of the specification and the drawings of the present invention under the invention idea of the present invention, directly or indirectly applied to other related technical fields, shall all be included in the scope of patent protection of the present invention.

What is claimed is:

1. A fan head, wherein an air inlet (24) and an air outlet (21) are provided on the fan head; a fan (4) and a driving assembly (6) of the fan (4) are arranged between the air inlet (24) and the air outlet (21); and the air outlet (21) is provided with an air guide frame (3) comprising a first air channel (32) and a second air channel (33), wherein the fan (4) comprises a hub (41) and at least two blades (43) arranged in a circumferential direction of the hub (41); each blade (43) comprises a first fan blade (433) and a second fan blade (434); the first fan blade (433) is connected to the hub (41); the second fan blade (434) is connected to the end of the first fan blade (433) that is away from the hub (41); the second fan blade (434) corresponds to the first air channel (32); and the first fan blade (433) corresponds to the second air channel (33);

wherein an angle (γ) is provided between planes or curved surfaces on which the same side surfaces of the first fan blade (433) and the second fan blade (434) are located; the first fan blade (433) is a first forward swept blade region (431); the second fan blade (434) is a second forward swept blade region or forward blade region (432); and a forward-sweep angle (α) of the first forward swept blade region (431) is greater than a forward-sweep angle (β) of the second forward swept blade region or forward blade region (432); and wherein the first fan blade (433) has an end surface (421) exposed between the first forward swept blade region (431) and the second forward swept blade region or forward blade region (432), so that at least part of the second fan blade (434) is staggered from the first fan blade (433) to allow the forward-sweep angle (α) of the first forward swept blade region (431) to be greater than the forward-sweep angle (β) of the second forward swept blade region or forward blade region (432).

2. The fan head according to claim 1, wherein the fan head further comprises a rear cover (5) arranged at the end that is near the air inlet (24); the side of the rear cover (5) that is away from the air inlet (24) abuts against the air guide frame (3) and is covered outside the fan (4) and the driving assembly (6) together with the air guide frame (3); the diameter of the end of the rear cover (5) that is near the air inlet (24) is less than the diameter of the end of the rear cover (5) that is away from the air inlet (24); and the diameter of the end of the air guide frame (3) that is near the air outlet (21) is less than the diameter of the end of the air guide frame (3) away from the air outlet (21).

3. The fan head according to claim 2, wherein the fan head further comprises a front frame (201) and a rear frame (202); the front frame (201) is detachably connected to the rear frame (202); the front frame (201) and the rear frame (202) are enclosed to form a cavity (203); the fan (4), the driving assembly (6), the air guide frame (3), and the rear cover (5) are all arranged in the cavity (203); the air inlet (24) is arranged at the end of the rear frame (202) that is away from the front frame (201); and the air outlet (21) is arranged at the end of the front frame (201) that is away from the rear frame (202).

4. The fan head according to claim 3, wherein the rear cover (5) is provided with an abutting rib (51); the abutting rib (51) abuts against the rear frame (202); and the air guide frame (3) is integrally formed with the front frame (201).

5. The fan head according to claim 1, wherein the fan head further comprises a decorative sheet (25); the decorative sheet (25) is detachably covered at the end of the air guide frame (3) that is away from the air inlet (24); the decorative sheet (25) is provided with a bump (251) and a positioning column (252); the air guide frame (3) is provided with a clamping slot (361) and a positioning hole (362); the positioning column (252) is threaded inside the positioning hole (362); the bump (251) and the clamping slot (361) are detachably fastened; the decorative sheet (25) is of a circular structure; and a central part protrudes towards the side away from the bump (251).

6. The fan head according to claim 1, wherein the fan further comprises a connector (44*a*); the connector (44*a*) connects the first fan blade (433*a*) to the second fan blade (434*a*); and the connector (44*a*) is annularly arranged outside the hub; and a distance from the connector (44*a*) to the air inlet (24) is less than a distance from the hub to the air inlet (24).

7. A handheld concentrating fan, comprising the fan head according to claim 1.

8. The fan head according to claim 1, wherein the air guide frame (3) comprises an inner frame (37) and a separator ring (34) arranged at a periphery of the inner frame (37); the first air channel (32) is formed in a periphery of the separator ring (34); the second air channel (33) is formed between the inner frame (37) and the separator ring (34); and the wind speed of wind exported from the second air channel (33) is greater than the wind speed of wind exported from the first air channel (32).

9. The fan head according to claim 8, wherein the air guide frame (3) further comprises a frame body (31); the frame body (31) is arranged at the periphery of the separator ring (34); and the first air channel (32) is located between the frame body (31) and the separator ring (34).

10. The fan head according to claim 9, wherein the air guide frame (3) further comprises a first grille (321); the first grille (321) is arranged in the first air channel (32); the air guide frame (3) further comprises a second grille (331); the second grille (331) is arranged in the second air channel (33); and the length of the first grille (321) in the air guide direction of the first air channel (32) is greater than the length of the second grille (331) in the air guide direction of the second air channel (33).

11. The fan head according to claim 10, wherein a plurality of first grilles (321) and a plurality of second grilles (331) are provided, and a quantity of the first grilles (321) is greater than or equal to a quantity of the second grilles (331).

12. The fan head according to claim 10, wherein the first grille (321) is connected between the frame body (31) and the separator ring (34); the second grille (331) is connected between the separator ring (34) and the inner frame (37); and the frame body (31), the first grille (321), the separator ring (34), the second grille (331), and the inner frame (37) are integrally formed.

13. The fan head according to claim 8, wherein the cross-sectional area of the side of the second air channel (33) that is near the fan (4) is greater than or equal to the cross-sectional area of the air outlet side of the second air channel (33).

* * * * *